US006601743B2

(12) United States Patent
Godshaw

(10) Patent No.: US 6,601,743 B2
(45) Date of Patent: Aug. 5, 2003

(54) COMBINATION BACKPACK AND DUFFEL BAG

(75) Inventor: Donald E. Godshaw, Evanston, IL (US)

(73) Assignee: Travel Caddy, Inc., Des Plaines, IL (US)

( * ) Notice: Subject to any disclaimer, the term of this patent is extended or adjusted under 35 U.S.C. 154(b) by 0 days.

(21) Appl. No.: 09/960,090

(22) Filed: Sep. 21, 2001

(65) Prior Publication Data

US 2003/0057239 A1 Mar. 27, 2003

(51) Int. Cl.[7] ..... A45F 4/02

(52) U.S. Cl. ..... 224/153; 224/580; 190/113; 190/115

(58) Field of Search ..... 224/153, 578, 224/579, 580; 190/113, 115

(56) References Cited

U.S. PATENT DOCUMENTS 3,019,952 A * 2/1962 Brewster ..... 294/142
3,622,056 A * 11/1971 Droeger ..... 224/153
4,210,186 A * 7/1980 Belenson ..... 206/316.2
4,334,601 A * 6/1982 Davis ..... 224/148.3
4,609,084 A * 9/1986 Thomas ..... 190/110
4,883,207 A * 11/1989 McArthur ..... 224/153
4,961,522 A * 10/1990 Weber ..... 224/585
5,799,851 A * 9/1998 Wulf et al. ..... 224/583
5,887,770 A * 3/1999 Covell ..... 224/153
5,964,384 A * 10/1999 Young ..... 224/153
6,305,587 B1 * 10/2001 Miller ..... 224/153

* cited by examiner

*Primary Examiner*—Stephen K. Cronin
(74) *Attorney, Agent, or Firm*—Banner & Witcoff, Ltd.

(57) ABSTRACT

A combination backpack and duffel bag in the form of a rectangular parallelpiped made from a flexible fabric material includes handles, and storage pockets for the handles when the bag is in the form of a duffel, and backpack straps stored in a side storage pocket for use in the backpack configuration.

7 Claims, 3 Drawing Sheets

COMBINATION BACKPACK AND DUFFEL BAG

BACKGROUND OF THE INVENTION

In a principal aspect the present invention relates to a bag or pack which may be utilized as a duffel bag or alternatively as a back pack.

Large duffel bags that are typically comprised of flexible fabric material or leather and normally have a generally rectangular parallelepiped shape. Also such bags conveniently hold a large amount of material or number of items and can be made to conform, at least in part, to the shape of the items, such as folded clothing, toiletries, etc. Further, such bags can typically be manufactured from lightweight materials, can be easily compacted for storage, and are generally economical relative to hard-sided luggage.

The movement of large duffel bags is, however, often difficult. Handles for the duffel bags may be provided, but such duffel bags are very cumbersome especially when the duffel bags are large sized.

An alternative to a duffel bag is to provide a backpack with backpack straps on one side of the bag. However, backpack straps are often a potential hazard when not in use. For example, when checked through as luggage on an airline, external back straps may provide a potential hazard by virtue of the fact that they can be caught in conveyor equipment, or the like. Thus there as developed a need to provide improved means for transport of large duffel bags.

SUMMARY OF THE INVENTION

Briefly, the present invention comprises a combination backpack and duffel bag which is made from a generally flexible material. When serving as a duffel bag, access to the bag is provided through a top side flap or opening which may be closed by means of a fastener. Handles are also provided on opposite sides of the access opening to the top of the bag. Small storage pockets are provided for the handles on each side of the access opening. As a further feature of the invention, a side access pocket of the bag is provided which includes at least first and second backpack straps that are fastened to the bag adjacent one end of the side access pocket which may be pulled from the side access pocket for attachment to fastener straps located adjacent the opposite end of the side of the backpack. When not in use, the backpack straps are retained safely within the side access pocket of the duffel bag. When required for use, the backpack straps are removed from the side access pocket and attached to provide first and second spaced backpack straps.

The combination backpack and duffel bag may thus be converted between the duffel bag form or embodiment and the backpack form or embodiment in a manner which safely stores the straps and/or handles associated with each particular form. Additional features include compression straps that facilitate maintaining the contents and shape of the backpack or duffel bag.

Thus it is an object of the invention to provide an improved combination backpack and duffel bag.

It is a further object of the invention to provide a combination backpack and duffel bag which is comprised of flexible material and which includes various pockets for storage of handles and/or straps.

Yet a further object of the invention is to provide a combination backpack and duffel bag which has a rugged and safe construction, is economical to manufacture, is foldable or compressible for easy storage, and which has a large storage capacity.

These and other objects, advantages and features will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENT

Figure 1:
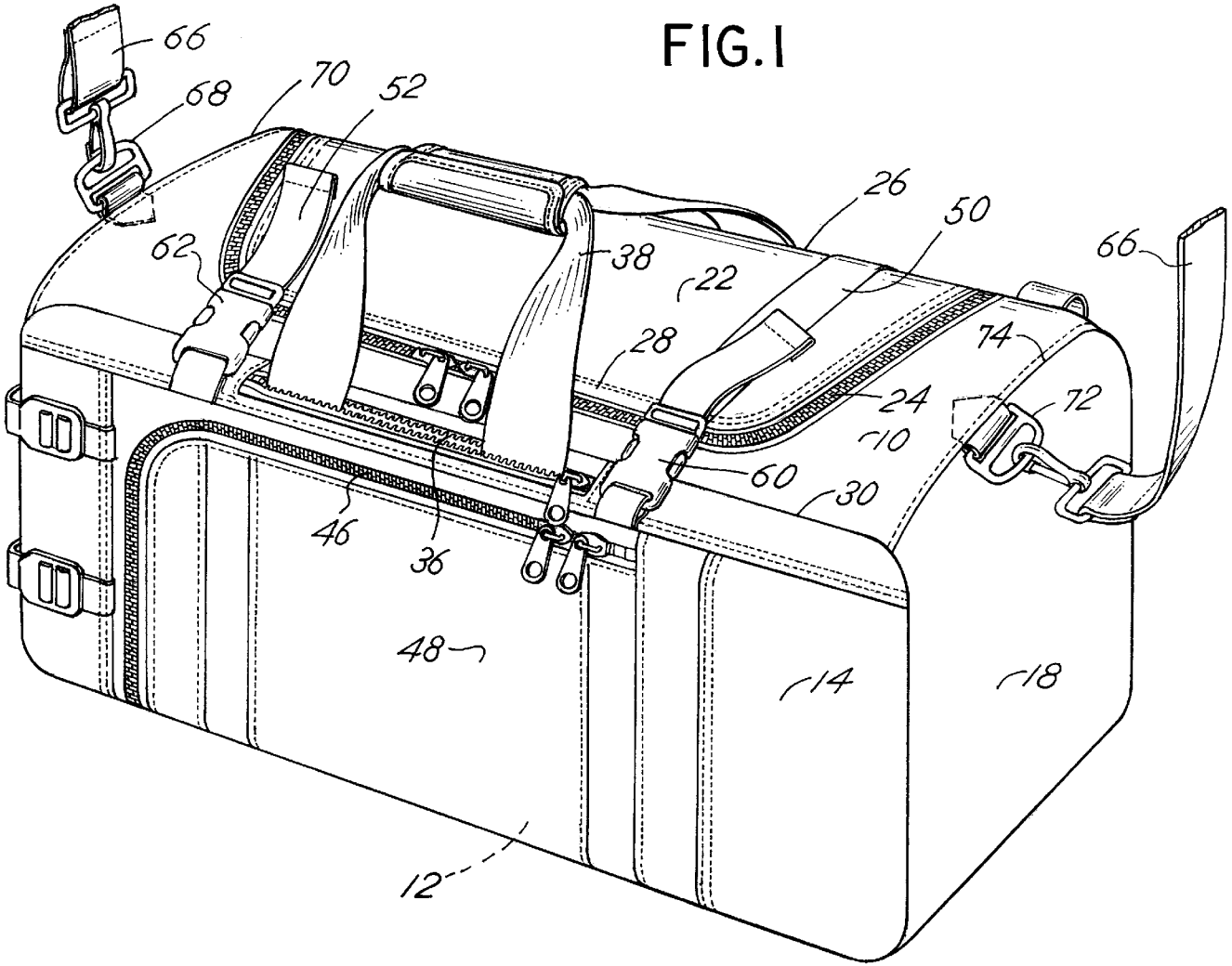
FIG. 1 is an isometric view of the combination backpack and duffel bag in the form or mode of a duffel bag.
Figure 2:
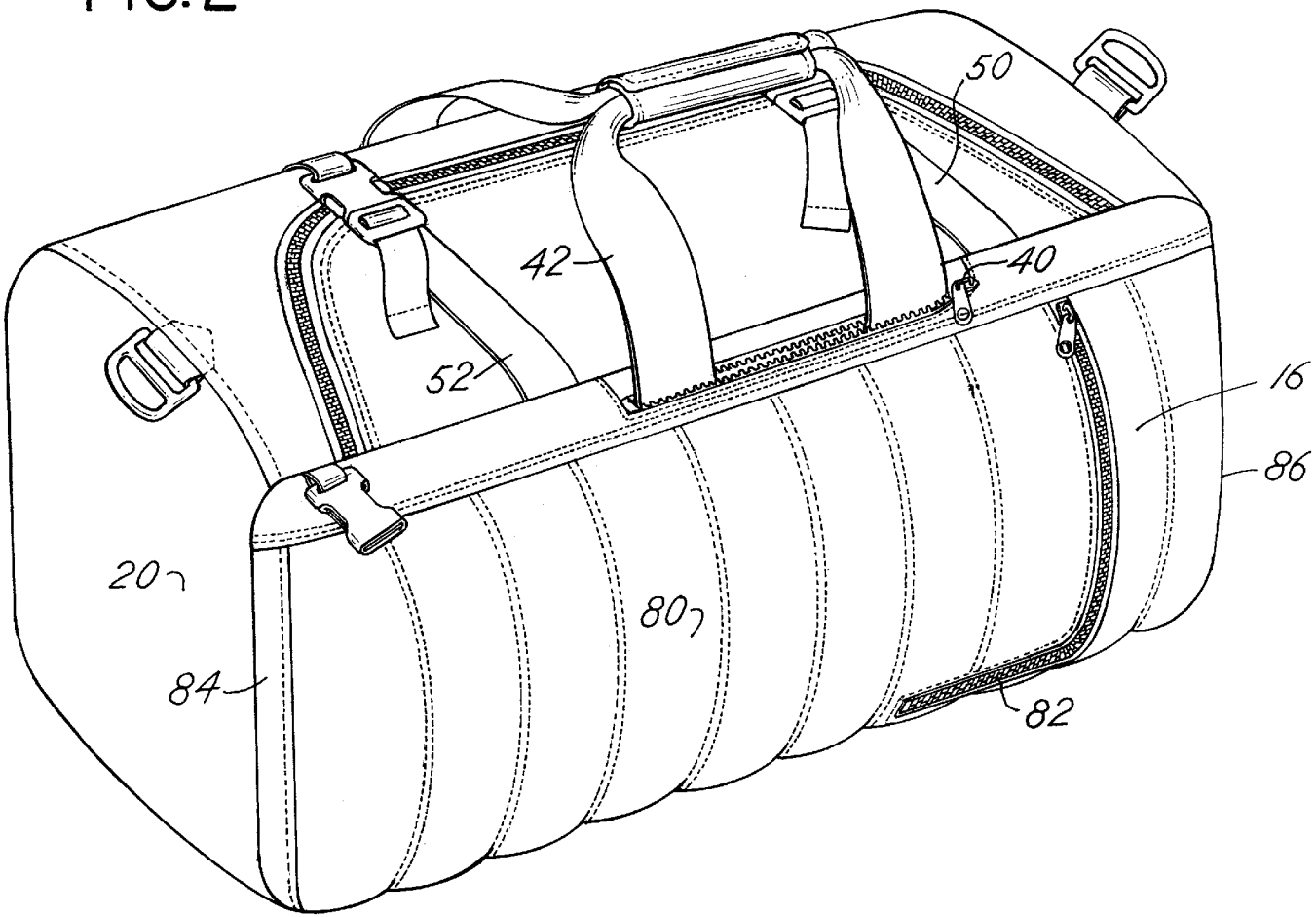
FIG. 2 is an isometric view of the backpack and duffel bag combination of FIG. 1 as viewed from the opposite side depicted in FIG. 1.
Figure 3:
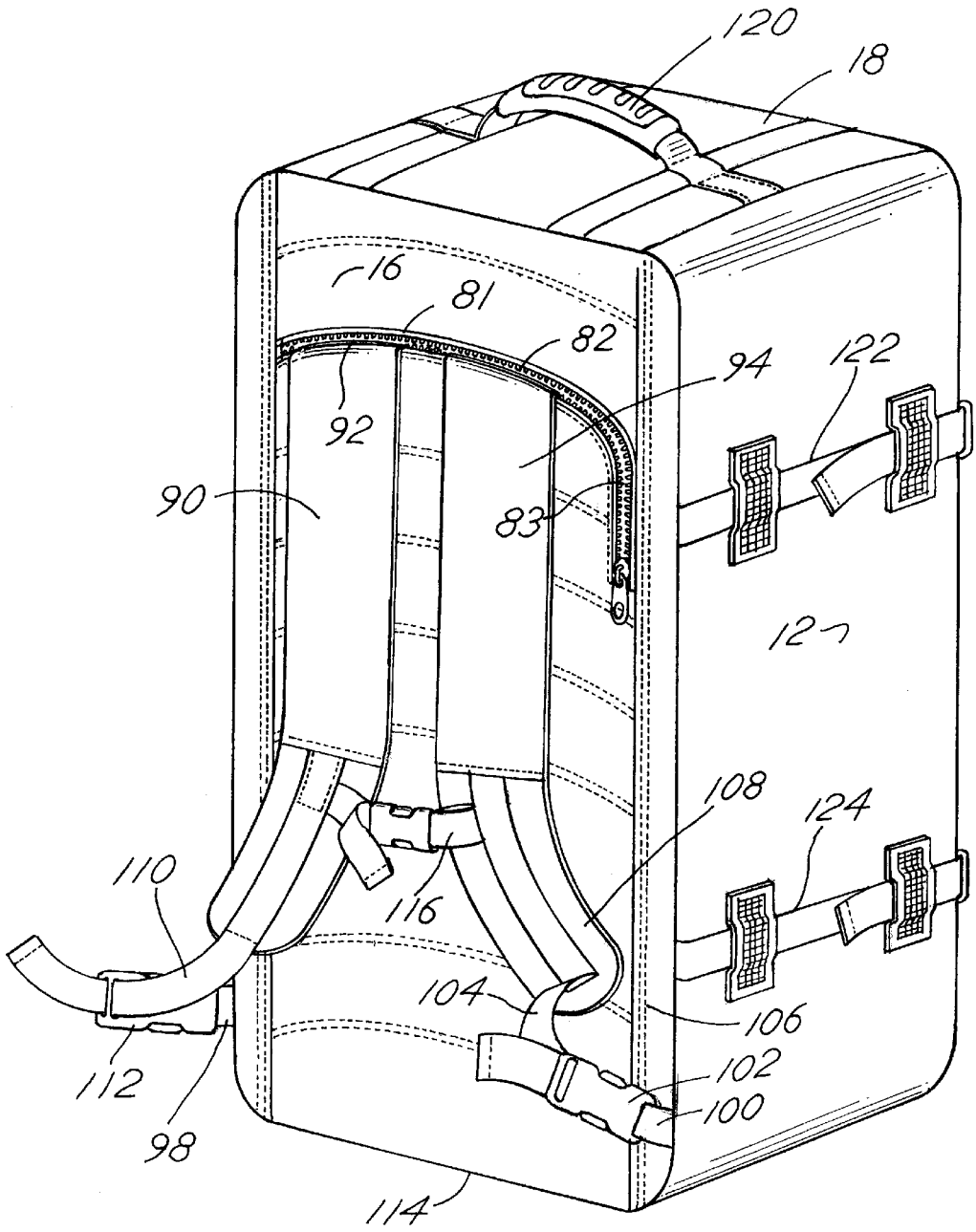
FIG. 3 is an isometric view of the backpack and duffel back combination of FIG. 1 converted to the backpack configuration.

FIGS. 1–3 depict a typical embodiment of the invention. The depiction in FIGS. 1 and 2 illustrates the use of the bag as a duffel bag. FIG. 3 illustrates utilization as a backpack.

Referring to the figures, the bag includes a top panel 10, a bottom panel 12, a first side panel 14, a second opposite generally parallel side panel 16, a first end panel 18 interconnecting side panels 14 and 16 as well as top panel 10 and bottom panel 12, and a second spaced end panel 20, generally parallel to and spaced from the end panel 18 and also connecting the side panels 14 and 16 as well as the top panel 10 and bottom panel 12. The described panels are fabricated, for example, by sewing them together to form a generally rectangular, parallelepiped, collapsible bag. The panels thus are made from a fabric or leather material which enables the bag to be folded or compressed when the contents are removed. Thus the bag may be easily stored when not in use or when prepared for shipping or packaged for inventory.

In the embodiment shown the top panel 10, bottom panel 12, are generally parallel and elongated. The side panels 14 and 16 are also generally parallel and elongated having a lengthwise dimension substantially equal to one another and to the lengthwise of the top panel 10 and the bottom panel 12.

The top panel 10 includes a flap 22 which is incorporated in the top panel 10 by means of a zipper connection 24. Thus the flap 22 will fold along an edge 26 and when the zipper 24 is opened, may be folded outwardly and upwardly to permit ingress to the interior of the bag. In the embodiment shown, the flap 22 has a trapezoidal shape with one side of the trapezoid, namely the long side of the trapezoid shape, associated with the edge junction between the top panel 10 and the second side panel 16. The flap 22 includes a narrower or less lengthy edge 28 parallel to the edge 26 and spaced from the edge 26 adjacent a junction or seam 30 between the top panel 10 and the first side panel 14. Thus there is a small section of the top panel 10 which is provided between the seam or edge 30 and the side 28 of the flap 22.

Integrated into the first side panel 14 is a zippered pocket having a zipper 36 for the top of a pocket integrally formed into the side panel 14. A first handle 38 may be folded into the pocket having the access opening associated with zipper 36. Similarly, the second side panel 16 includes zipper access 40 to a pocket which receives a second handle member 42. Handle members 38 and 42 are thus made from a flexible fabric material and may be stored in their respective pockets associated with the zipper openings or zippers 36 and 40, respectively.

Referring again to the first side panel 14, an L-shaped opening defined by a zipper 46 is provided for an outer pocket in the side wall 14. Thus a flap 48 provide a pocket which overlies the side panel 14. The pocket defined by the flap 48 may serve to retain important papers, or the like.

Referring again to FIG. 1, supplemental retaining straps 50 and 52 are provided over the top panel 10 extending from the margin or edge 26 to a fastener or clip 60 and 62, respectively, at the second margin or edge 30. The straps 50 and 52 are adjustable and serve to facilitate maintenance of the shape of the bag and retention of the contents by the flap 22 particularly in the event that the zipper 28 fails.

In addition to the handles 38 and 42 which are provided for carrying of the duffel bag in the duffel bag configuration, a shoulder strap 66 extends between loop or fastener 68 at edge 70 of the end panel 20 to a loop or fastener 72 at the edge 74 of the first end panel 18. Strap 66 comprises further means for carrying the duffel bag. That is, the shoulder strap 66 which is adjustable and removable is provided for carrying the duffel bag over a shoulder, for example.

Referring to FIG. 2, the second panel 16 includes a flap 80 which fits over a majority of the surface of the second panel 16 and is retained on the panel 16 by means of a L-shaped zipper 82 defining an L-shaped opening with first and second legs 81, 83 for the pocket defined by the flap 80. Leg 81 is adjacent end panel 18. Leg 83 is adjacent the edge of bottom panel 12 which joins side panel 16. The pocket extends from the edge 84 of the back panel connection to the end panel 20 upwardly to a position adjacent the edge 86 associated with the connection of panel 16 with panel 18. The storage flap 80 which defines a pocket retains shoulder straps as more fully depicted in FIG. 3.

That is, as depicted in FIG. 3, a first shoulder strap 90 having a top end 92 is fastened to the side panel 16 on the inside of the pocket or flap 80 adjacent the zipper connection 82. A second shoulder strap 94 is likewise fastened to panel 16 and is arranged parallel to and generally side by side to the first strap 90. The second strap 94 is also fastened to the back panel 16 on the inside of the pocket defined by the flap 80 adjacent the zipper connection 82. The straps 90 and 94 are elongate straps and are connectible to retaining straps 98 and 100, respectively. The retaining strap 100 fits and is connected to a coupler 102 which, in turn, is attached to an adjustable strap 104 that has its opposite end fixed to the seam or junction 106 between panel 16 and the bottom panel 12. The adjustable strap 104 fits through a loop in the back strap 94, namely through the loop 108. This is a first means of connecting the back strap 94 to the bottom of the panel 16. The first back pack strap 90 includes a strap 110 which connects directly to a fastener 112 that is affixed to the retention strap 98. Thus the length of each of the straps 90 and 92 is effectively adjustable and also each is detachable for storage in the pocket 80. The particular connection arrangement may be adjusted or altered to be identical for both straps 90 and 94. Thus the drawing illustrates various alternative means for connecting the strap 90, 94 to the bottom region of the panel 16 adjacent the edge 114.

A further adjustment feature of the straps 90, 92 includes an adjustable cross or connecting strap 116 connecting the back straps 90 and 94. The adjustable connecting strap 116 serves to maintain the straps 90 and 94, more particularly the top region of the straps 90 and 94, properly over the shoulders of a person which is utilizing the bag as a backpack. Thus a person will fit their arms through the straps 90 and 94 above the connecting or cross strap 116. Importantly the connecting strap 116 is adjustable to accommodate the size of the individual using the bag in the backpack form.

Additional supplemental features for the invention include a carrying handle 120 attached on the end panel 18. Adjustable length compression straps 122 and 124 fitted around the bag may also be utilized to facilitate the maintenance of the shape and form of the bag particularly when serving as a back pack. Thus it is possible to vary the types of connectors and restraining straps without departing from the spirit and scope of the invention. The invention is therefore to be limited only by the following claims and equivalents thereof.

What is claimed is:

1. A combination back pack and duffel bag, comprising in combination:

a flexible bag having a generally rectangular parallelpiped shape and including a top panel, a bottom panel, a first side panel and a second side panel, a first end panel and a second end panel;

said top panel including a top access flap for ingress to the bag;

said first side panel including a first side access flap with an access opening defining a side pocket, said access opening to the side pocket adjacent one end panel, said side pocket including first and second back straps which are stored in the side pocket and removable therefrom, each of said straps being attached at one end to the first side panel and being attachable at the opposite end thereof to the bag adjacent the other end panel to thereby provide a back pack.

2. The bag of claim 1 wherein the side panels each include a storage pocket adjacent the intersection of the top panel with the side panel, and wherein each storage pocket includes a removable handle for carrying the bag as a duffel bag.

3. The bag of claim 2, wherein each storage pocket includes a closure fastener.

4. The bag of claim 1, 2, or 3 including a carry strap attached between the end panels.

5. The bag of claims 1, 2, or 3 further including at least one compression strap extending around the outside of the bag top, side, and bottom panels.

6. The bag of claim 1 further including a closure fastener for the access opening of the side pocket.

7. The bag of claim 1 wherein the side access flap comprises an L-shaped opening with a first leg of the opening adjacent said one end panel and the second leg of the opening adjacent the junction between the side panel and bottom panel.

* * * * *